US010876359B2

(12) United States Patent
Purcell et al.

(10) Patent No.: US 10,876,359 B2
(45) Date of Patent: Dec. 29, 2020

(54) MULTI-ACCUMULATOR ARRANGEMENT FOR HYDRAULIC PERCUSSION MECHANISM

(71) Applicant: MINCON INTERNATIONAL LIMITED, Shannon (IE)

(72) Inventors: Joseph Purcell, Ennis (IE); John Kosovich, Ennis (IE)

(73) Assignee: MINCON INTERNATIONAL LIMITED, Shannon (IE)

( * ) Notice: Subject to any disclaimer, the term of this patent is extended or adjusted under 35 U.S.C. 154(b) by 376 days.

(21) Appl. No.: 14/900,338

(22) PCT Filed: Jun. 26, 2014

(86) PCT No.: PCT/EP2014/063622
§ 371 (c)(1),
(2) Date: Dec. 21, 2015

(87) PCT Pub. No.: WO2014/207164
PCT Pub. Date: Dec. 31, 2014

(65) Prior Publication Data

US 2016/0369565 A1 Dec. 22, 2016

(30) Foreign Application Priority Data

Jun. 28, 2013 (GB) ..... 1311674.4

(51) Int. Cl.
*E21B 4/06* (2006.01)
*E21B 4/14* (2006.01)
(Continued)

(52) U.S. Cl.
CPC . *E21B 4/14* (2013.01); *E21B 1/00* (2013.01)

(58) Field of Classification Search
None
See application file for complete search history.

(56) References Cited

U.S. PATENT DOCUMENTS 3,465,834 A 9/1969 Southworth, Jr.
3,911,789 A * 10/1975 Bouyoucos ..... F01L 23/00 91/321

(Continued)

FOREIGN PATENT DOCUMENTS

WO WO 98/51900 11/1998
WO WO 2012/138287 A1 10/2012

OTHER PUBLICATIONS

International Search Report issued in corresponding International Patent Application No. PCT/EP2014/063622, dated May 22, 2015.

(Continued)

*Primary Examiner* — Matthew R Buck
*Assistant Examiner* — Douglas S Wood
(74) *Attorney, Agent, or Firm* — Kusner & Jaffe

(57) ABSTRACT

The present invention relates to a hydraulically powered percussion mechanism (12), comprising a piston (6) to impact a percussion bit (8). The percussion mechanism also includes a first accumulator assembly (3*a*) for hydraulic fluid. The first accumulator assembly comprises a plurality of first accumulator elements (27). In a first aspect, the plurality of first accumulator elements are arranged in a common housing (14). In a second aspect, each of the first accumulator elements is arranged at the same proximity to the piston. In a third aspect, each of the first accumulator elements comprises an accumulator membrane (32) or piston, and wherein the primary direction of movement of the membrane or piston in contact with the hydraulic fluid is substantially parallel to a longitudinal axis of the mechanism.

20 Claims, 9 Drawing Sheets

(51) Int. Cl.
*E21B 1/00* (2006.01)
*F15B 1/04* (2006.01)

(56) References Cited

U.S. PATENT DOCUMENTS

| | | | | |
|---|---|---|---|---|
| 4,022,108 | A * | 5/1977 | Juvonen | B25D 9/12 91/276 |
| 6,752,222 | B2 * | 6/2004 | Karasawa | E21B 4/003 173/78 |
| 9,151,117 | B2 * | 10/2015 | Connell | E21B 7/022 |
| 2014/0060932 | A1 * | 3/2014 | Connell | E21B 7/022 175/40 |

OTHER PUBLICATIONS

"Drilling Method Guide," Blasthole Drilling in Open Pit Mining, Atlas Copco, pp. 176.
Website print out of "DTH Drilling Tools," www.gmd-eqpt.com/info/difference-between-dth-drilling-and-top-hammer-28535883.html, print out date, Mar. 26, 2019.
Website print out of "Down-the-Hole Drill," en.wikipedia.org/wiki/Down-the-hole_drill, print out date, Mar. 26, 2019.
Website print out of "Top Hammer Vs and Down the Hole Drilling Difference, Rock Drilling Machines," readcivil.com/top-hammer-vs-and-down-the-hole-drilling-difference-rock-drilling-machines, print out date Mar. 26, 2019.

* cited by examiner

MULTI-ACCUMULATOR ARRANGEMENT FOR HYDRAULIC PERCUSSION MECHANISM

RELATED APPLICATIONS

This application is a National Stage of International Application No. PCT/EP2014/063622 filed Jun. 26, 2014, which claims the benefit of United Kingdom Patent Application No. 1311674.4, filed Jun. 28, 2013.

FIELD OF THE INVENTION

The present invention relates to accumulator arrangements for percussion mechanisms, and in particular, to accumulator arrangements for hydraulic down-the-hole hammers.

BACKGROUND TO THE INVENTION

Hydraulically powered percussion mechanisms are employed in a wide variety of equipment used to drill rock. A number of different variations of percussion mechanism exist, both for top hammer systems and down-the-hole systems. Such variations include mechanisms with a control valve, known as a shuttle valve, and those where the control valve is replaced with a special port layout, known as valveless mechanisms.

The majority of percussion mechanisms in common use include three principal components:

1. An impact piston to impart percussion energy to a drill bit or tool located at a forward end of the mechanism;
2. A shuttle valve to control the flow of hydraulic fluid in the percussion mechanism to apply pressure to faces of the impact piston, thereby creating cyclical forces that cause reciprocal motion of the piston; and
3. An accumulator to take in, store, and deliver back pressurised hydraulic fluid to accommodate the varying instantaneous flow requirements created by the reciprocation of the piston.

Hydraulic fluid is supplied at a constant flow rate from a base machine to which the percussion mechanism is fitted. The fluid is fed to the shuttle valve and the accumulator in parallel. Depending on the position of the piston in the cycle, the hydraulic fluid can either pass through the shuttle valve to move the impact piston, or can fill the accumulator. However, the accumulator is normally configured so that it will only take in hydraulic fluid once the pressure of the fluid has reached a certain minimum level, know as the accumulator pre-charge pressure.

At either end of the piston cycle, when the piston is instantaneously stationary, there is no requirement for hydraulic flow to the piston and so the fluid pressure builds up to the accumulator pre-charge pressure and flows into the accumulator. However, as it is fed in parallel, this pressure also acts on the impact piston via the shuttle valve and creates a force which accelerates the piston away from the stationary end position. The accumulator receives a smaller and smaller portion of the supplied fluid as the piston gains speed. At a certain point in the cycle, the piston will have gained enough speed to consume all of the supplied fluid. This fluid is still being supplied at the accumulator pre-charge pressure, as a minimum, and thus, the piston keeps accelerating under the force of the fluid. At this point, the accumulator stops receiving fluid and begins supplying fluid back into the system. The pressurised fluid flows out of the accumulator, allowing the piston to achieve a higher speed.

This continues until either the accumulator has fully discharged its stored fluid or the piston strikes the drill bit or tool, thus coming to a stop and beginning the process again.

The ability of the accumulator to store and deliver hydraulic fluid is critical to the performance of the percussion mechanism. If the accumulator cannot store enough fluid, or cannot receive it fast enough, or cannot deliver it back fast enough, the maximum speed of the piston will be limited, thus limiting the blow energy of the piston. The maximum impact frequency of the percussion mechanism will also be limited. A cyclical load will also be placed on the base machine at the frequency of reciprocation of the piston, which is detrimental to the reliability of the base machine.

The power output of a percussion mechanism is proportional to both blow energy and impact frequency. Since both blow energy and impact frequency can be limited by poor accumulator performance, the performance of the accumulator governs the maximum power, and thus maximum performance, of the percussion mechanism. In order to ensure good accumulator performance, several factors must be taken into account, namely, storage capacity, response time, and reliability.

In high frequency percussion mechanisms, the placement of the accumulator is also very important. The closer the accumulator is to the shuttle valve, the faster its response in storing or supplying fluid will be. A fast response is important in achieving maximum blow energy at high frequencies. The placement of the accumulator can also affect the reliability of the percussion mechanism. The more remote the location of the accumulator, the greater the volume of fluid that must accelerate and decelerate in response to the movement of the shuttle valve. The percussion mechanism is more susceptible to damaging pressure fluctuations known as "fluid hammer" as the volume of fluid in motion increases.

To date, hydraulic down-the-hole hammers as described in International Patent Application Publication No. WO 2010/033041 and International Patent Application Publication No. WO 96/20330 use a single accumulator, separate to the percussion mechanism. The reason for this is that a down-the-hole percussion drill tool is constrained in size and shape, since it must fit inside the hole it is drilling. It is therefore difficult to arrive at an accumulator arrangement which optimises the factors affecting accumulator performance within the constraints of the down-the-hole drill tool.

SUMMARY OF THE INVENTION

According to an aspect of the present invention, there is provided a hydraulically powered percussion mechanism, comprising:

a piston to impact a percussion bit; and a first accumulator assembly for hydraulic fluid;

characterised in that the first accumulator assembly comprises a plurality of first accumulator elements in a common housing.

An advantage of this arrangement is that the use of a plurality of accumulator elements increases the overall storage capacity of the accumulator assembly, as compared with single accumulator arrangements. Reliability is also increased, since if one of the accumulator elements fails, the other elements in the assembly will continue to function normally. Another advantage is that the greater the number of accumulator elements that are provided, the less movement is required by each element and thus, the overall response time of the accumulator assembly is improved. A further advantage is that a common housing maximises the cross-sectional area available to each accumulator housing, as compared with using multiple accumulators, each in its own housing.

According to another aspect of the invention, there is provided a hydraulically powered percussion mechanism, comprising:

a piston to impact a percussion bit; and a first accumulator assembly for hydraulic fluid;

characterised in that the first accumulator assembly comprises a plurality of first accumulator elements, wherein each of the first accumulator elements is arranged at the same proximity to the piston, that is, equidistant from the piston.

This arrangement enjoys many of the advantages set out above, in particular, improved storage capacity, reliability and response time. An advantage of arranging each of the accumulator elements at the same proximity to the piston is that the overall distance travelled by the hydraulic fluid into and out of the accumulator elements may be minimised.

According to a further aspect of the invention, there is provided a hydraulically powered percussion mechanism, comprising:

a piston to impact a percussion bit; and a first accumulator assembly for hydraulic fluid;

characterised in that the first accumulator assembly comprises a plurality of first accumulator elements, wherein each of the first accumulator elements comprises an accumulator membrane or piston, and wherein the primary direction of movement of the membrane or piston in contact with the hydraulic fluid is substantially parallel to a longitudinal axis of the mechanism.

This arrangement also enjoys the advantages set out above, in particular, improved storage capacity, reliability and response time. An advantage of arranging the accumulator elements such that the primary direction of movement of the membranes or pistons is longitudinal is that the fluid is discharged from the accumulator elements in the direction of the piston. Longitudinal movement of the accumulator membranes is also advantageous for applications of the percussion mechanism such as down-the-hole hammers, where the elements of the hammer are arranged one after another along its length.

One or more of the features of the above-mentioned aspects of the invention may be combined in a single embodiment.

The percussion mechanism may further comprise:

a shuttle valve to control reciprocation of the piston, the shuttle valve having a shuttle valve diameter; and wherein the first accumulator assembly is arranged proximate or adjacent to the shuttle valve.

The percussion mechanism may further comprise:

a discharge chamber;

wherein each of the first accumulator elements is arranged such that fluid discharged therefrom is discharged into the discharge chamber.

The discharge chamber may be adjacent to the shuttle valve.

Each of the first accumulator elements may be arranged at the same proximity to the common discharge chamber.

An advantage of this arrangement is that the path of pressure fluid from each element to the shuttle valve is the same. The path of pressure fluid from the accumulator elements may therefore be minimised, thereby improving the response time of the accumulator assembly and reducing the possibility of damaging "fluid hammer" effects.

The shuttle valve typically has a surface that controls flow of fluid into and out of the first accumulator assembly. In an embodiment, each of the first accumulator elements comprises an accumulator membrane or piston, and the minimum distance between at least one accumulator membrane or piston and the shuttle valve surface during operation of the percussion mechanism is less than or equal to three times the shuttle valve diameter from the shuttle valve surface.

In an embodiment, the first accumulator elements are arranged in a polar array about a longitudinal axis of the percussion mechanism.

In an embodiment, each of the first accumulator elements includes a gas-filled bladder or membrane.

Each of the first accumulator elements may be arranged at the same longitudinal position in the mechanism, that is, at the same proximity to the shuttle valve.

The first accumulator assembly may be a pressure accumulator assembly. Alternatively, the first accumulator assembly may be a return accumulator assembly. In another embodiment, each of the first accumulator elements is individually configurable as either a pressure accumulator or a return accumulator.

In an embodiment, the percussion mechanism may further comprise:

a second accumulator assembly, comprising a plurality of second accumulator elements in a common housing, wherein each of the second accumulator elements is individually configurable as either a pressure accumulator or a return accumulator.

The percussion mechanism may further comprise:

an adapter housing, connectable to the second accumulator assembly to configure each of the second accumulator elements as either a pressure accumulator or a return accumulator.

According to a further aspect of the present invention, there is provided a hydraulically powered percussion mechanism, comprising:

a piston to impact a percussion bit;

a shuttle valve to control reciprocation of the piston, the shuttle valve having a shuttle valve diameter;

a first accumulator assembly for hydraulic fluid, arranged proximate to the shuttle valve, wherein the shuttle valve has a surface that controls flow of fluid into and out of the first accumulator assembly; and characterised in that the first accumulator assembly comprises a plurality of first accumulator elements and wherein each of the first accumulator elements comprises an accumulator membrane or piston, and wherein the minimum distance between at least one accumulator membrane or piston and the shuttle valve surface during operation of the percussion mechanism is less than or equal to three times the shuttle valve diameter from the shuttle valve surface and the minimum distance between at least one other accumulator membrane or piston and the shuttle valve surface during operation of the percussion mechanism is less than or equal to ten times the shuttle valve diameter from the shuttle valve surface.

According to an aspect of the invention, there is provided a hydraulic down-the-hole hammer, comprising:

the percussion mechanism described above.

The hydraulic down-the-hole hammer may further comprise:

an external cylindrical outer wear sleeve, the piston mounted for reciprocating movement within the outer wear sleeve to strike the percussion bit, wherein the percussion bit is located at a forward end of the outer wear sleeve.

In an embodiment, the hydraulic down-the hole hammer comprises:

a shuttle valve to control reciprocation of the piston, the shuttle valve having a shuttle valve diameter and that controls flow of fluid into and out of the first accumulator assembly, wherein the first accumulator assembly is arranged proximate to the shuttle valve; and wherein each of the first accumulator elements comprises an accumulator membrane or piston, and wherein the minimum distance between at least one accumulator membrane or piston and the shuttle valve surface during operation of the percussion mechanism less than or equal to ten times the shuttle valve diameter from the shuttle valve surface.

DETAILED DESCRIPTION OF THE DRAWINGS

Figure 1:
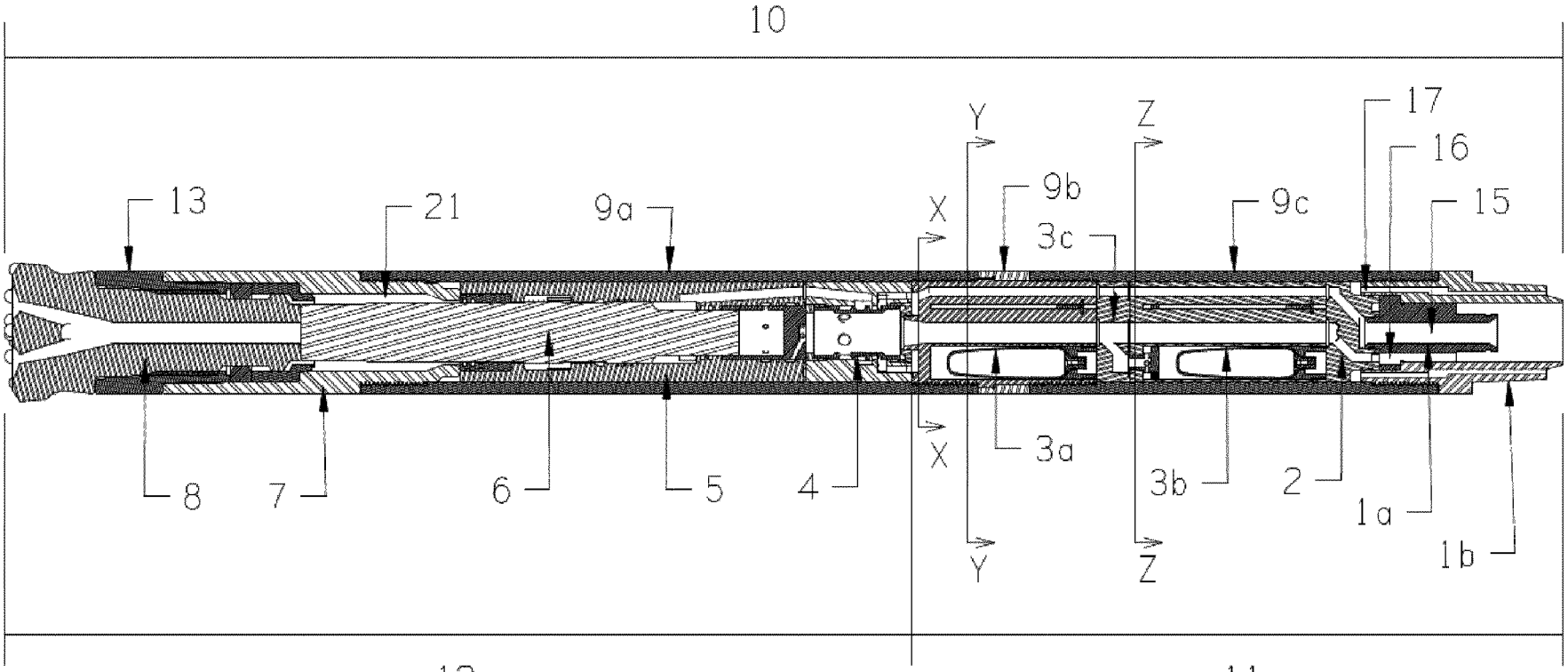
FIG. 1 is a sectional side elevation of a hydraulic down-the-hole hammer according to an embodiment of the invention.

A hydraulic down-the-hole hammer 10 according to an embodiment of the invention is illustrated in FIG. 1. The hammer 10 comprises an accumulator cartridge 11 and a percussion cartridge 12. The percussion cartridge comprises an external cylindrical outer wear sleeve 9*a*. An inner cylinder 5 is mounted co-axially within the outer wear sleeve. A sliding impact piston 6 is mounted for reciprocating movement within the inner cylinder 5 and the outer wear sleeve 9*a*, to strike a hammer bit 8 located at the forward end of the outer wear sleeve to exercise a percussive force to the drill bit.

Outer wear sleeve 9*a* is screw-threadably connected to a bit housing 7 by means of an internal screw thread provided at a forward end of wear sleeve 9*a* and a co-operating external screw thread provided at a rear end of bit housing 7. The bit housing is provided with an external annular shoulder which acts as a stop when the housing 7 is screwed into the outer wear sleeve 9*a*. Rotational forces are transferred from the rotating outer wear sleeve 9*a* to the bit by means of a hollow cylindrical chuck 13 mounted at a forward end of bit housing 7. The chuck is machined internally to provide a plurality of axially extending splines on its internal wall which engage with complementary splines on the shank of the hammer bit 8 to transmit rotational drive from the chuck to the drill bit. An upper part of the chuck is externally screw-threaded for connection to the bit housing 7. The chuck is also provided with an external annular shoulder which acts as a stop when the chuck is screwed into the bit housing 7.

The percussion cartridge further comprises a shuttle valve and housing 4. The shuttle valve controls reciprocation of the piston 6 and has a shuttle valve diameter D. The shuttle valve has a surface 29 that controls flow of fluid into and out of the first accumulator assembly 3*a*.

The accumulator cartridge 11 comprises an external cylindrical outer wear sleeve, having two sections 9*b* and 9*c*. First and second accumulator assemblies 3*a* and 3*b* are co-axially mounted within the outer wear sleeve 9*b*, 9*c*. The accumulator cartridge further comprises an adapter housing 3*c*, discussed in further detail below. A connection valve 1 and a manifold 2 are provided at rear end of the hammer 10.

The accumulator cartridge 11 is connected to the percussion cartridge 12 by way of a screw-threaded connection between the first accumulator assembly 3*a* and the outer wear sleeve 9*a*. The first accumulator assembly 3*a* comprises a housing 14 having external screw threads provided at forward and rear ends thereof and external splines provided therebetween. The screw threads provided at the forward end of first accumulator assembly housing 14 are engaged with internal screw threads provided on the rear end of outer wear sleeve 9*a*. Wear sleeve 9*b* is internally splined to engage with the external splines on housing 14. Wear sleeve 9*b* protects the first accumulator assembly 3*a* during operation and also provides, via the splined engagement with the housing 14, a means of rotating the housing for assembly and disassembly. Wear sleeve 9*c* is also internally screw-threaded at both ends, and is connected at its forward end to the external screw thread provided at the rear end of housing 14. The rear end of outer wear sleeve 9*c* is screw-threadably connected to the backhead assembly 1*a*, 1*b* of the hammer.

The various components of the percussion cartridge and the accumulator cartridge are held in contact with one another by way of the opposing forces created by the various screw-threaded connections between the components.

The hammer 10 is connected to a base machine by way of one or more drill rods. The connection valve 1 is selected to correctly interface the hammer to the particular rod used. The connection valve comprises a central pressure fluid path 15 and a return fluid path 16, concentric to and outside the pressure fluid path. The connection valve further includes a flushing fluid path 17 concentric to and outside the return fluid path. The function of the manifold 2 is to swap the positions of the pressure and return fluid paths so that the pressure fluid path is concentric to and outside the return fluid path. A single return fluid channel 18 runs through the centre of the hammer 10, from the centre of shuttle valve 4 through the centre of accumulator assemblies 3*a* and 3*b*. In the embodiment shown in FIG. 1, the pressure fluid is carried in a plurality of channels 19 located towards the periphery of the components. Flushing fluid is carried in a plurality of channels 20 formed between the wear sleeves and the internal components of the hammer. At the forward end of the hammer, flushing fluid flows through channel 21 in the bit housing 7 and out through the bit and into the hole being drilled.

Figure 2:
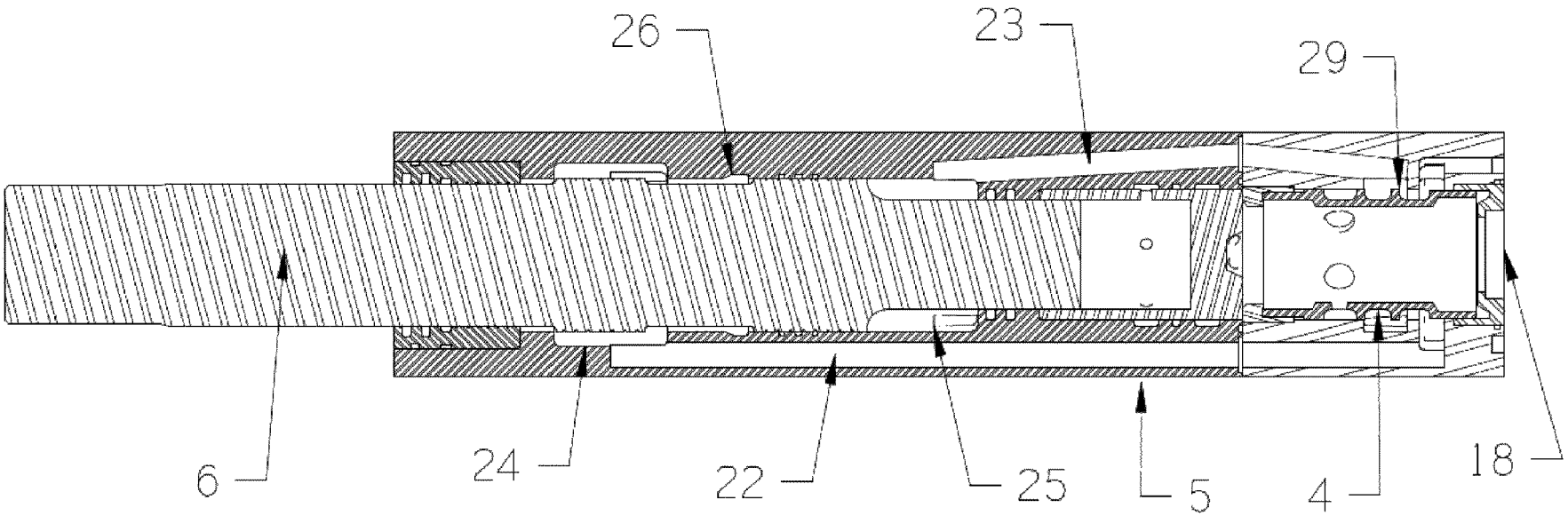
FIG. 2 is an enlarged sectional side elevation of a central part of FIG. 1.

FIG. 2 shows the cylinder 5, piston 6 and shuttle valve 4 of the percussion cartridge in more detail. Two groups of channels 22, 23 carry fluid through the cylinder. The bottom group 22 of five channels carry fluid to the forward end of the cylinder and the top group 23 of five channels carry fluid to the rear end of the cylinder. The impact piston 6 has an outer diameter which provides a very close fit within cylinder 5, effectively creating three distinct chambers in the cylinder. The bottom chamber 24 is in fluid communication with the bottom group of channels 22. The top chamber 25 is in fluid communication with the top group of channels 23. Depending on the position of the piston 6, the middle chamber 26 may be in fluid communication with either the bottom chamber 24 or the return fluid channel 18.

Figure 3:
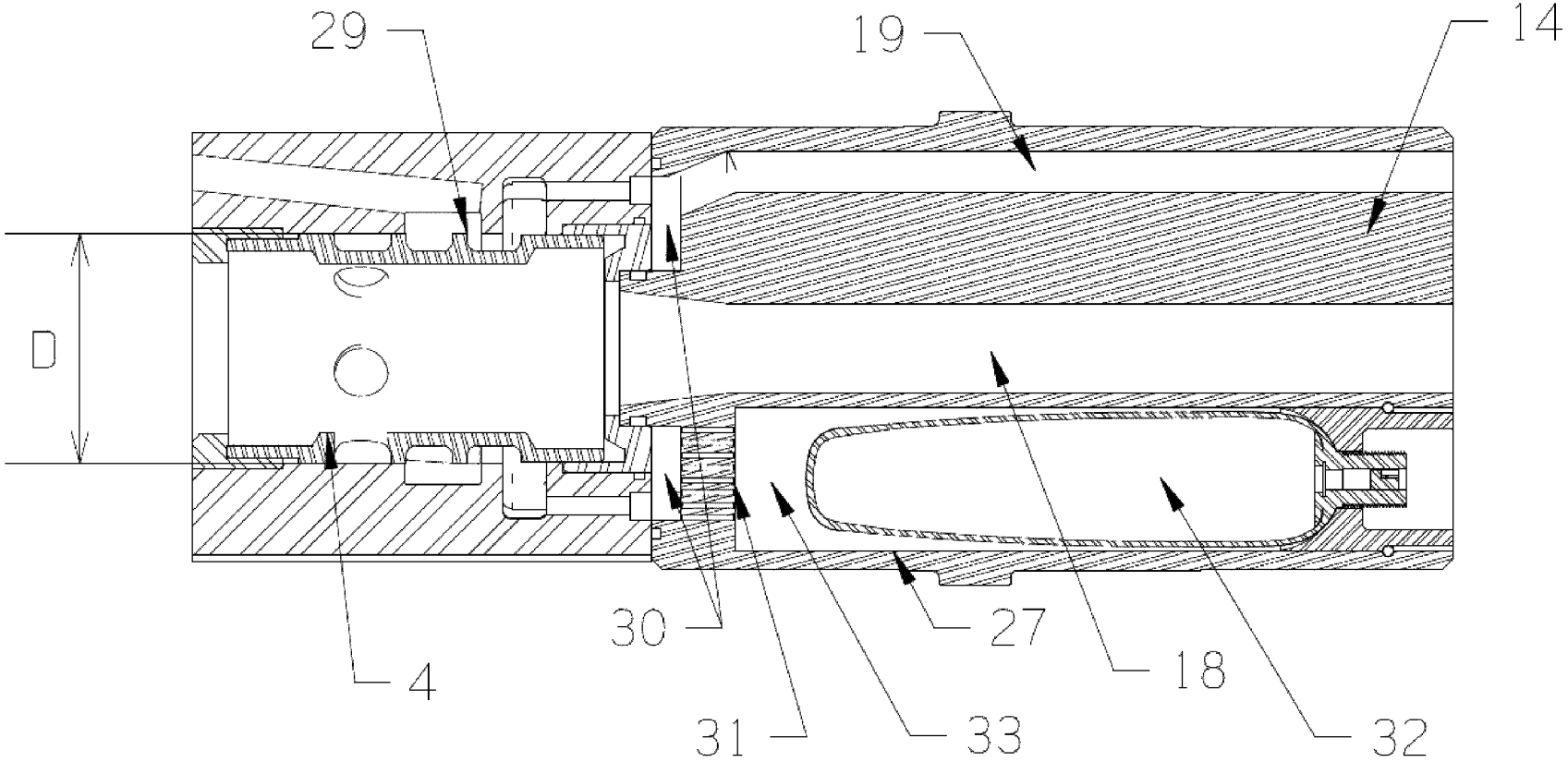
FIG. 3 is a an enlarged sectional side elevation of an upper part of FIG. 1.
Figure 4:
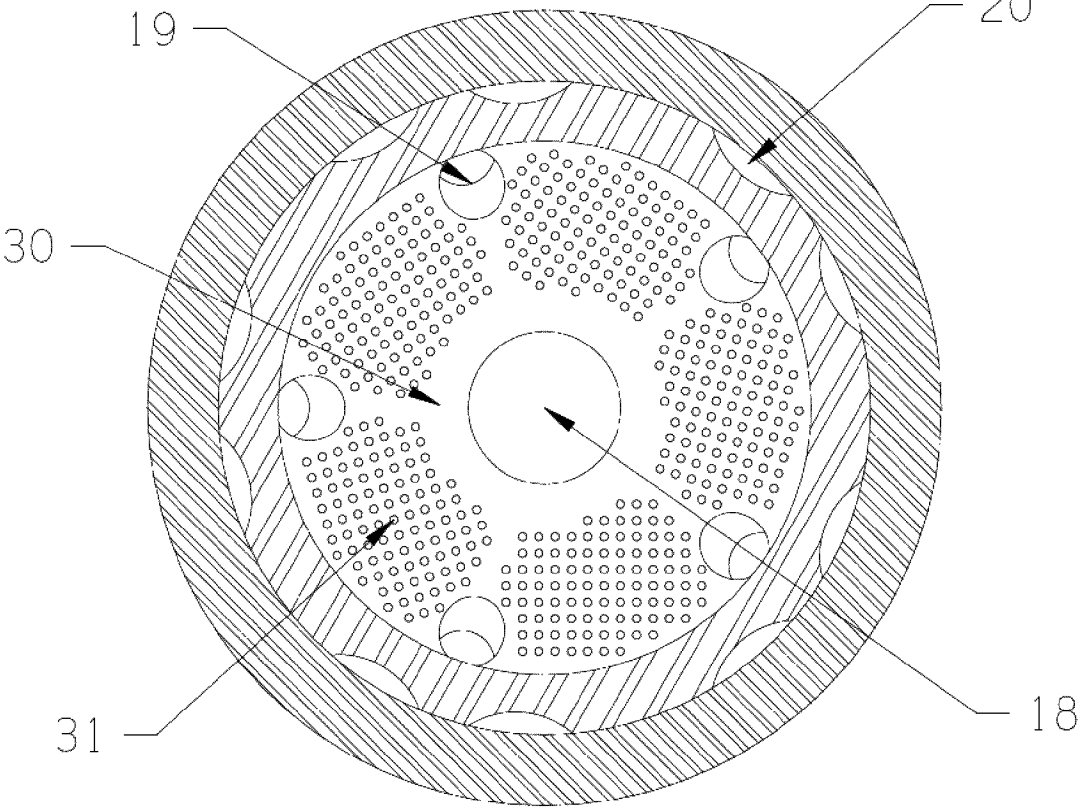
FIG. 4 is a cross-sectional view of the first accumulator assembly taken along line X-X of FIG. 1.
Figure 5:
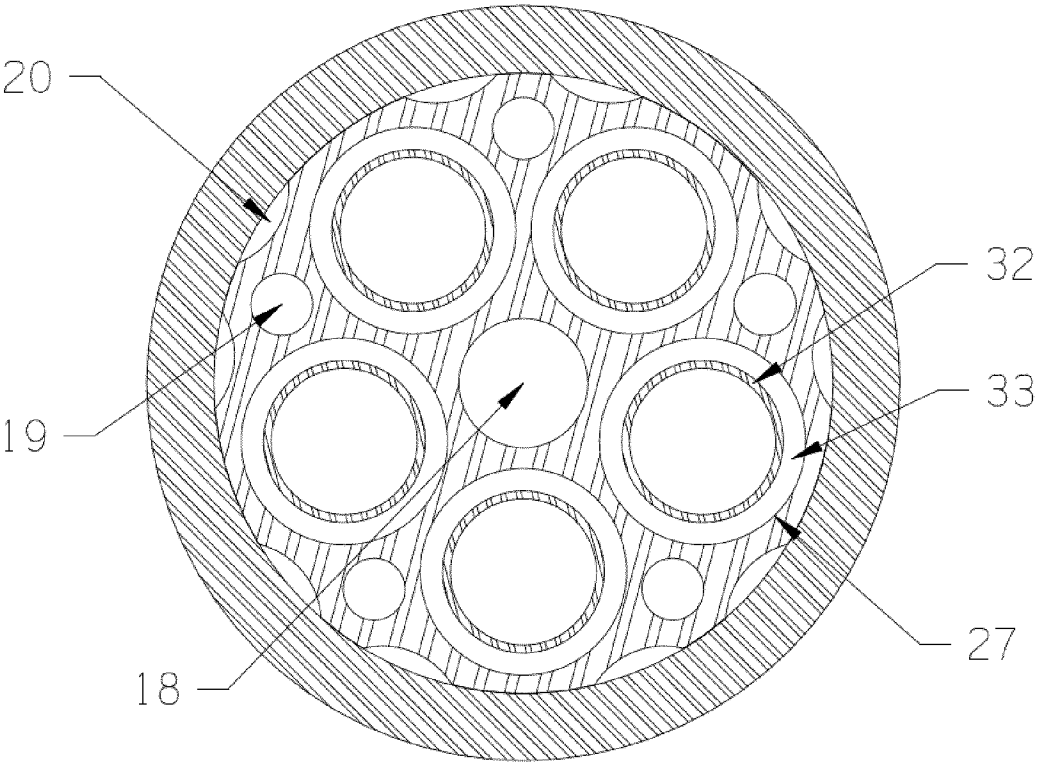
FIG. 5 is a cross-sectional view of the first accumulator assembly taken along line Y-Y of FIG. 1.

FIGS. 3, 4, 5, 6*a* and 6*b* show the first accumulator assembly 3*a* in more detail. As shown in FIGS. 3 and 4, first accumulator assembly 3*a* comprises housing 14 as described above. Five first accumulator elements 27, each including a gas-filled bladder or membrane 32 disposed in a chamber 33, are arranged in a symmetrical polar array around the longitudinal axis of the hammer 10 in the common housing 14. The first accumulator assembly 3*a* also comprises a common discharge chamber 30 adjacent to the shuttle valve 4, wherein each of the first accumulator elements 27 is arranged such that fluid discharged therefrom is discharged into the common discharge chamber via channels 31. Each of the first accumulator elements 27 is arranged at the same proximity to the common discharge chamber 30, and at the same longitudinal position in the hammer 10. Thus, each of the first accumulator elements 27 is equidistant from the impact piston 6. In alternate embodiments, different numbers of first accumulator elements may be provided and/or they may be arranged asymmetrically. In alternate embodiments, the first accumulator elements may comprise gas-charged diaphragms or gas-charged pistons, in place of the gas-filled bladders 32.

Figure 6B:
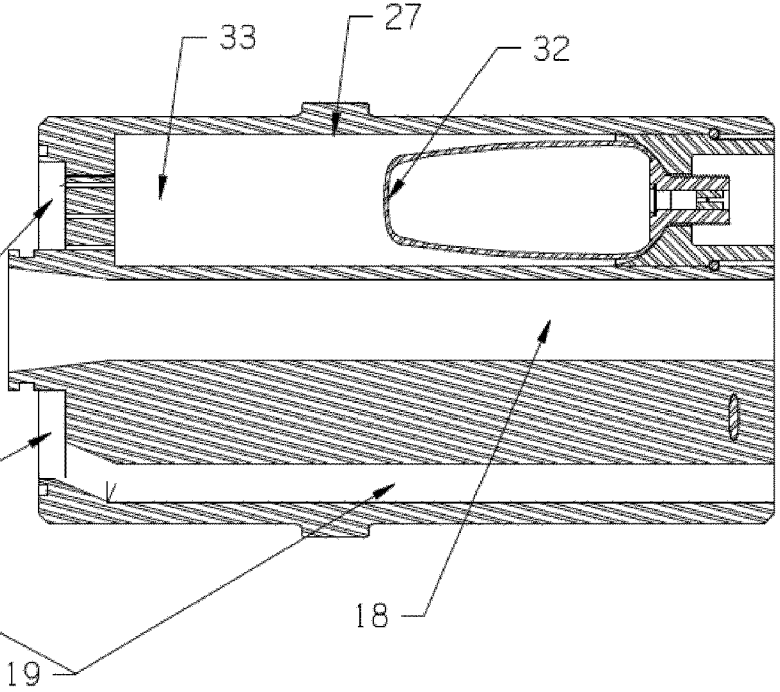
FIGS. 6*a* and 6*b* are enlarged sectional side elevations of the first accumulator assembly of FIG. 1, showing an accumulator element storing different amounts of pressure fluid.
Figure 6A:
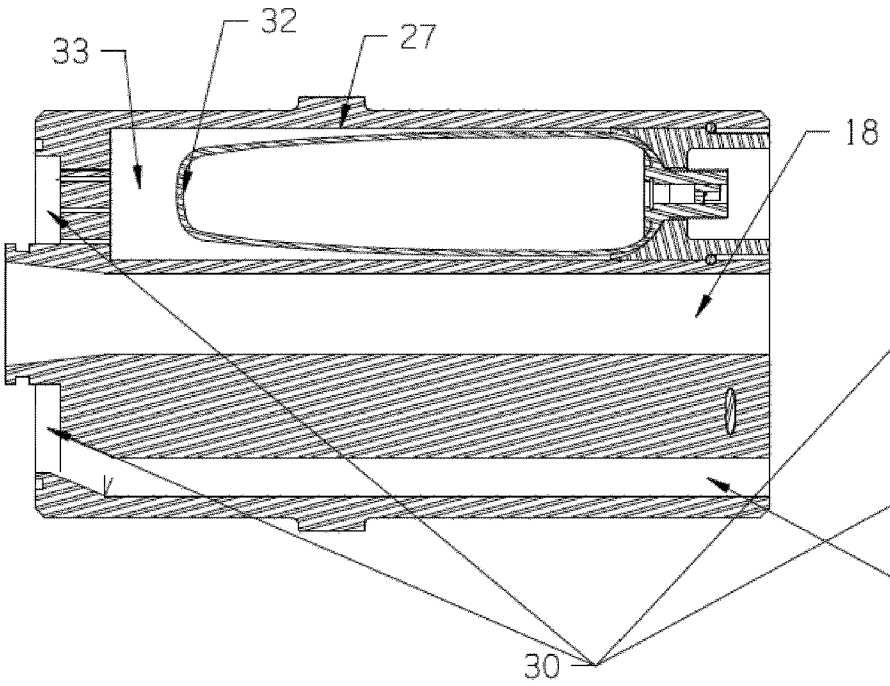

FIGS. 6*a* and 6*b* show an accumulator element 27 at two different points in the piston cycle. FIG. 6*b* shows the element 27 storing a larger amount of pressure fluid that FIG. 6*b*. As shown in the drawings, the primary direction of movement of the membrane 32 is substantially parallel to a longitudinal axis of the mechanism. These figures illustrate the movement required by one accumulator element to operate the percussion mechanism of the hammer on its own. The greater the number of elements 27 that are provided, the less movement is required by each element and thus, the overall response time of the accumulator assembly is improved. Also, the more elements 27 that are provided, the lower the fluid velocity will be, thereby reducing "fluid hammer" effects.

Figure 7:
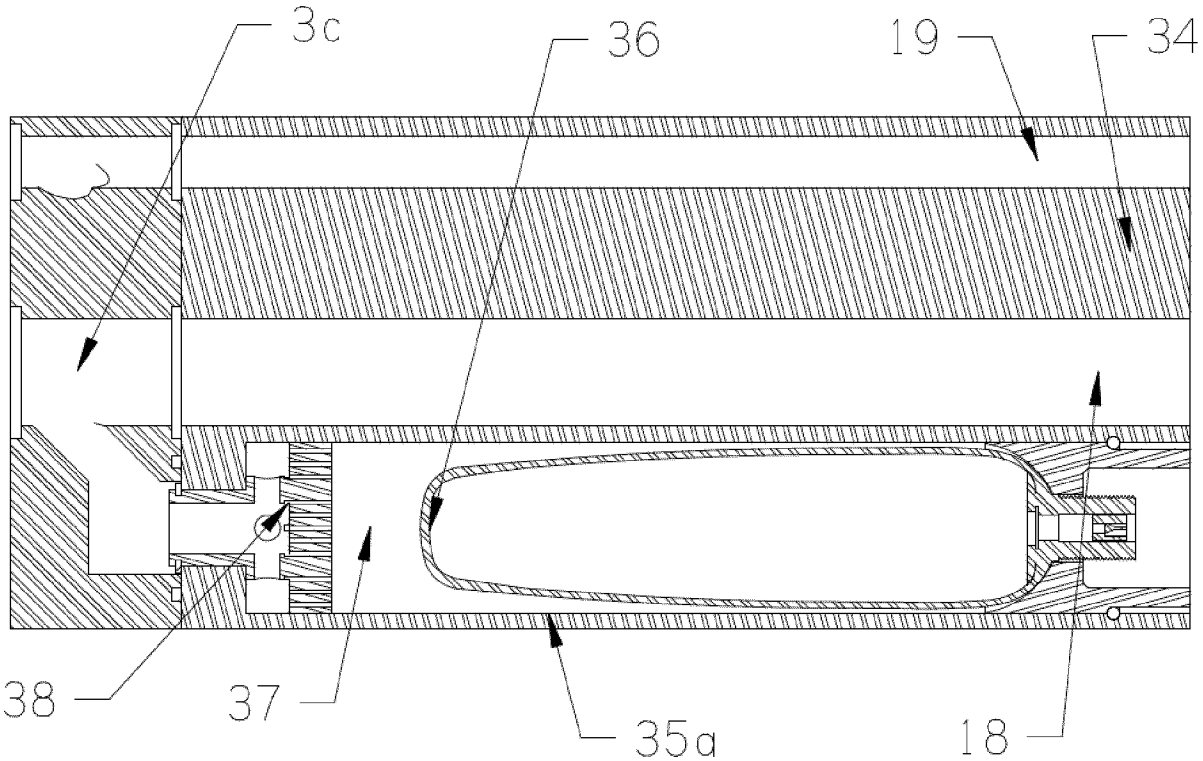
FIG. 7 is an enlarged sectional side elevation of the second accumulator assembly of FIG. 1.
Figure 8:
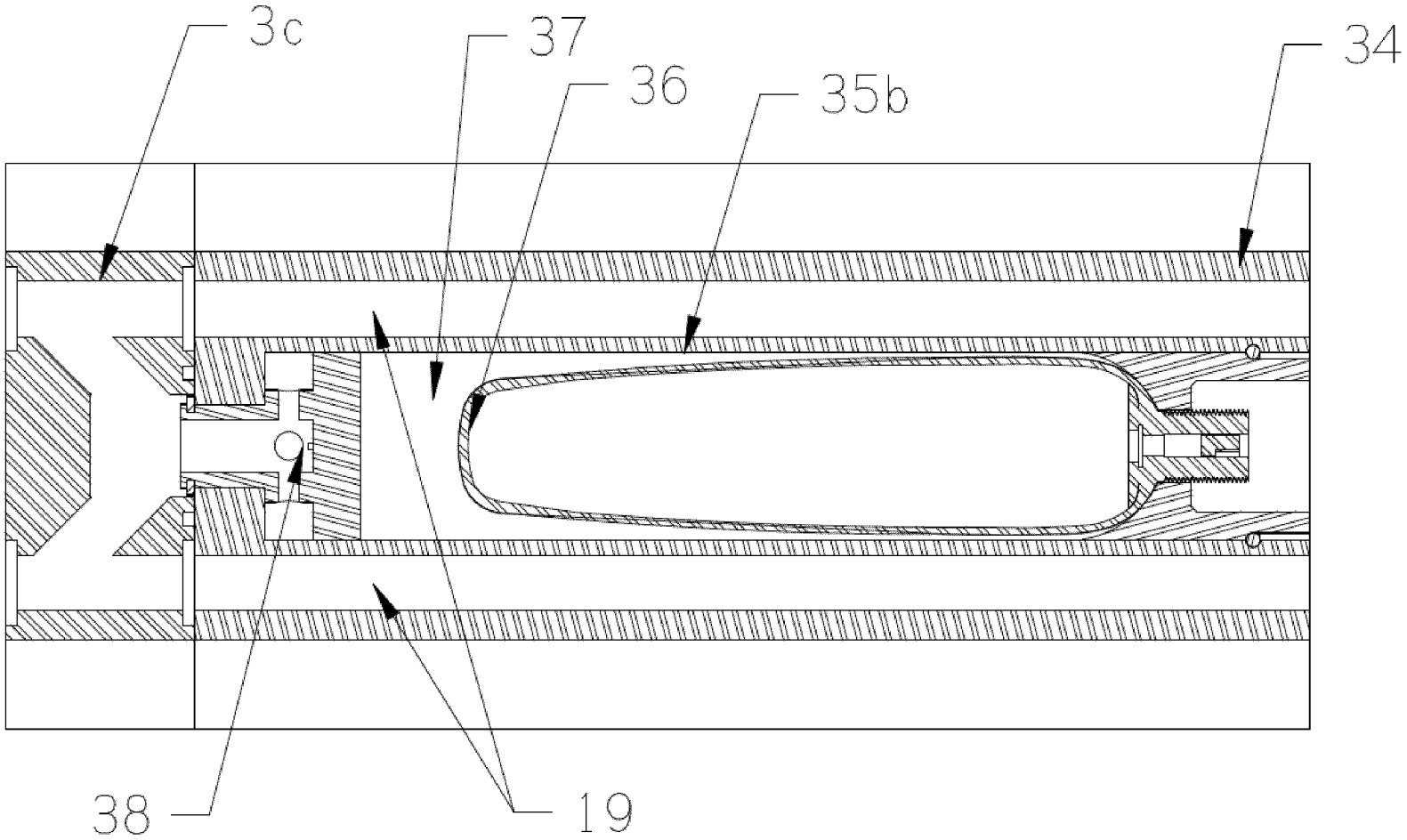
FIG. 8 is an enlarged sectional side elevation of an alternate second accumulator assembly.
Figure 9:
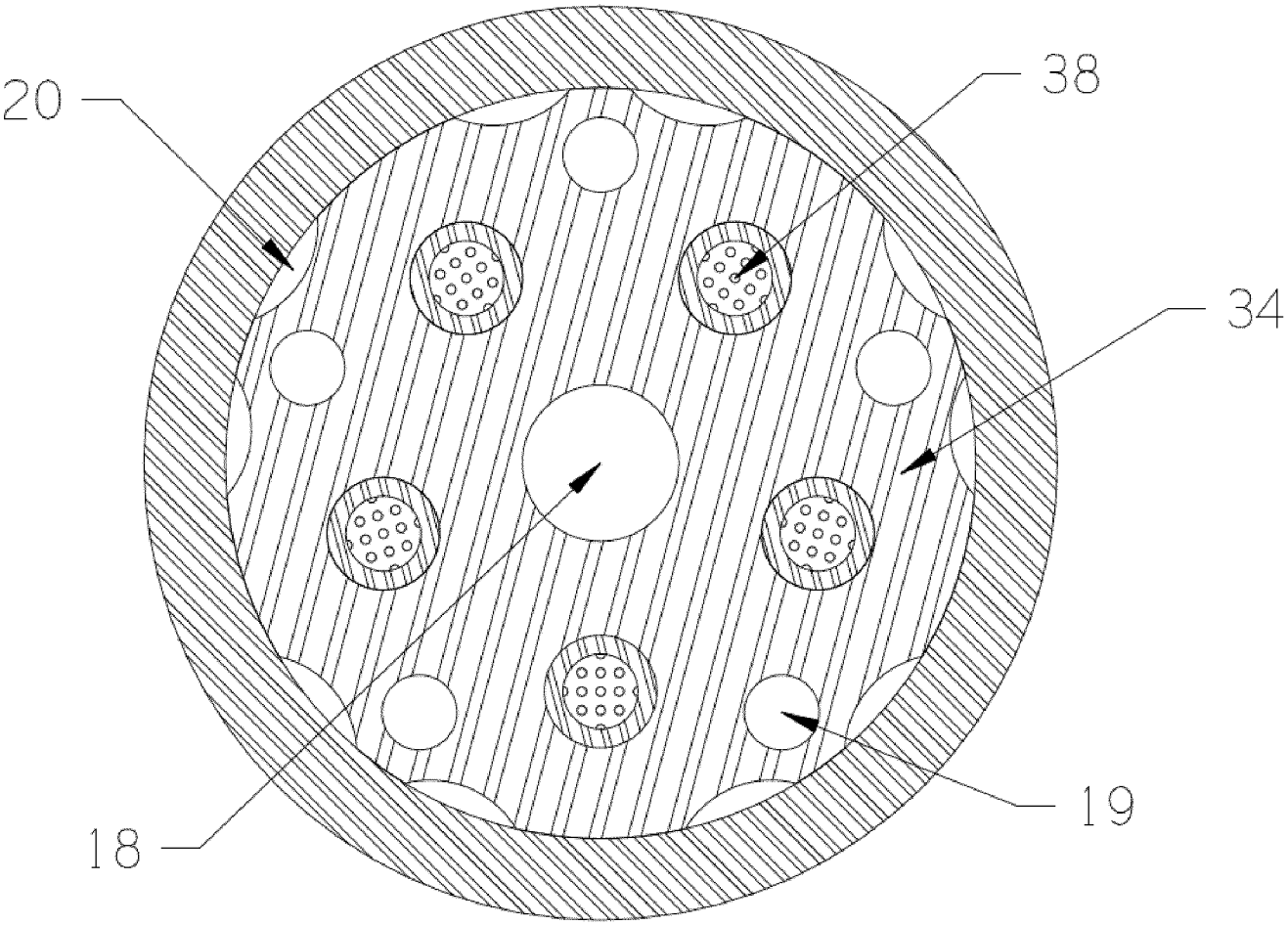
FIG. 9 is a cross-sectional view of the second accumulator assembly taken along line Z-Z of FIG. 1.

As shown in more detail in FIGS. 7 to 9, the hammer 10 further comprises a second accumulator assembly 3*b* comprising a housing 34. Five second accumulator elements 35, each including a gas-filled bladder or membrane 36 disposed in a chamber 37, are arranged in a symmetrical polar array around the longitudinal axis of the hammer 10 in the common housing. 34. In alternate embodiments, different numbers of second accumulator elements may be provided and/or they may be arranged asymmetrically Each of the second accumulator elements 35 is individually configurable as either a pressure accumulator or a return accumulator. Elements configured as pressure accumulators are supplemental to the first accumulator assembly 3*a*. Elements configured as return accumulators are used to "smooth" the return fluid flow back to the base machines, so that drill rods and base machine hydraulics are not subjected to a pulsating return flow, thereby improving the reliability of the hammer and the base machine.

Second accumulator assembly 3*b* comprises a plurality of discharge fittings 38. Discharge fittings 38 connect to an adapter housing 3*c* to configure each of the second accumulator elements as either a pressure accumulator or a return accumulator. The adapter housing 3*c* is provided with drillings which connect the individual accumulator elements 35 with the central return channel 18, as shown in FIG. 7, or with the surrounding pressure channels 19, as shown in FIG. 8. Thus, the element 35*a* shown in FIG. 7 is configured as a return accumulator, while the element 35*b* shown in FIG. 8 is configured as a pressure accumulator. A range of adapter housings can be used to configure second accumulator assembly 3*b* to have an appropriate mix of pressure and return accumulator elements, as defined by the end user. The housing 34, the accumulator elements 35 and the discharge fittings 38 remain the same regardless of the selected configuration; only the adapter housing 3*c* need be changed and the pre-charge pressures of the individual elements set accordingly.

Three fluid flows are required for operation of the hammer. Pressure fluid flows to the hammer 10 from the base machine and provides the energy to drive the hammer. Return fluid flows away from the hammer 10 at low pressure, back to the base machine. Flushing fluid flows through the hammer, exiting via the bit 8 and then out of the hole being drilled to evacuate the drill cuttings. Generally, the pressure and return fluid is oil and the flushing fluid is air, but other combinations are possible.

The bottom chamber 24 in the cylinder 5 is permanently fed with pressure fluid via the pressure channels 19 and the bottom group of channels 22 in the cylinder. The top chamber 25 is intermittently pressurised via the top group of channels 23, which are either fed with pressure fluid or are connected to the return fluid channel 18 depending on the position of the shuttle valve 4. The middle chamber 26 of the cylinder 5 is also intermittently pressurised, depending on the position of the impact piston 6 within the cylinder 5. When the impact piston 6 is close to the hammer bit 8, the middle chamber 26 is connected to the bottom chamber 24 and is thus pressurised. When the impact piston is close to the top of stroke, the middle chamber is connected to the return fluid line 18 and is thus depressurised.

Pressure in the middle chamber 26 controls the shuttle valve position. At the start of the cycle, when the middle chamber is depressurised, the shuttle valve 4 moves to supply pressure to the top chamber 25. At this stage, first accumulator elements 27 and the pressure elements in second accumulator assembly 3*b* are receiving the full fluid flow from the base machine and are therefore storing fluid. At this point in the cycle, the area of the impact piston exposed to the top chamber 25 is greater than the area exposed to the bottom chamber 24, and a net downward-acting force is created which drives the impact piston forward towards the bit 8. As the impact piston accelerates downwards, the flow going into the pressure accumulators gradually decreases to zero at about the quarter-stroke position. From this point on, the accumulators start delivering oil, adding to that coming from the base machine to allow the piston to keep accelerating to its full strike speed. The accumulators' ability to deliver fluid quickly is most critical just before the strike point. If the impact piston can "outrun" the oil supply, its maximum speed will be limited. Once the impact piston gets close to the bit, a path opens for the pressure fluid to flow into the middle chamber 26. With the middle chamber now pressurised, the shuttle valve moves to connect the top chamber 25 to the return fluid channel 18. The force on the top of the impact piston drops away accordingly and the net force acting on the piston therefore reverses direction. Once the impact piston is brought to rest by its collision with the bit, this force accelerates the piston away from the bit. At the strike point, the pressure accumulators will have discharged most of their stored fluid. When the impact piston is brought to rest, the accumulators are required to quickly begin storing supplied fluid again. It is at this point in the cycle that the accumulators' response time in storing fluid and location is most critical. If the volume of fluid in motion at this time is too great, or if the accumulator cannot begin storing sufficient oil quickly enough, dangerous pressure spikes will be created. As the impact piston gains speed upward, the fluid flowing into the accumulators reduces. Then, when the impact piston reaches a certain point on its upward travel, the supply of pressure fluid to the middle chamber is again cut off and the middle chamber is connected to the return fluid path 18. This causes the shuttle valve to move back to its original position, connecting the top chamber 25 to the pressure channels 19. At this point, the accumulators are required to quickly begin storing the fluid being displaced from top chamber 25 by the movement of the piston until it is brought to rest. Once again, the response time and location of the accumulator are very important in enabling control of the pressure transients created at this time. With the middle chamber depressurised and the piston now at the top of its stroke, the cycle begins again. The accumulators are required to store fluid for approximately 75% of the cycle and are then required to deliver it back over the other 25%. Accumulator response time is thus fundamental to the performance of the mechanism, especially as the frequency increases.

The embodiment described above includes a shuttle valve equipped percussion mechanism in a hydraulic down-the-hole hammer. However, the present invention is equally applicable to all forms of percussion mechanism, including those of a valveless design.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A hydraulic down-the-hole-hammer, comprising:

a hydraulically powered percussion mechanism, comprising:

a piston configured to impact a percussion bit; and a first accumulator assembly for hydraulic fluid, the first accumulator assembly comprising a plurality of first accumulator elements fully encased in a monolithic common housing, each of the first accumulator elements being arranged at the same longitudinal position in the mechanism, at least one of the first accumulator elements being a pressure accumulator, at least another one of the first accumulator elements being a return accumulator; and an external cylindrical outer wear sleeve within which the hydraulically powered percussion mechanism is disposed entirely, wherein the piston is mounted to reciprocate movement within the outer wear sleeve to strike the percussion bit, and wherein the percussion bit is located at a forward end of the outer wear sleeve.

2. A hydraulic down-the-hole hammer as claimed in claim 1, wherein the percussion mechanism further comprises a shuttle valve configured to control reciprocation of the piston, the shuttle valve having a shuttle valve diameter, and wherein the first accumulator assembly is arranged proximate to the shuttle valve.

3. A hydraulic down-the-hole hammer as claimed in claim 1, wherein each of the first accumulator elements is arranged such that fluid discharged therefrom is discharged into a common discharge chamber.

4. A hydraulic down-the-hole hammer as claimed in claim 3, wherein each of the first accumulator elements is arranged at the same proximity to the common discharge chamber.

5. A hydraulic down-the-hole hammer as claimed in claim 2, wherein the shuttle valve has a surface that controls flow of fluid into and out of the first accumulator assembly, wherein each of the first accumulator elements comprises an accumulator membrane or an accumulator piston, and wherein a minimum distance between at least one of the accumulator membranes or accumulator pistons and the shuttle valve surface during operation of the percussion mechanism is less than or equal to three times the shuttle valve diameter.

6. A hydraulic down-the-hole hammer as claimed in claim 1, wherein the first accumulator elements are arranged in a polar array about a longitudinal axis of the percussion mechanism.

7. A hydraulic down-the-hole hammer as claimed in claim 1, wherein each of the first accumulator elements includes a gas-filled bladder or membrane.

8. A hydraulic down-the-hole hammer as claimed in claim 1, wherein each of the first accumulator elements is individually configurable as either a pressure accumulator or a return accumulator.

9. A hydraulic down-the-hole hammer as claimed in claim 1, wherein the percussion mechanism further comprises a second accumulator assembly, the second accumulator assembly comprising a plurality of second accumulator elements in a common housing, wherein each of the second accumulator elements is individually configurable as either a pressure accumulator or a return accumulator.

10. A hydraulic down-the-hole hammer as claimed in claim 9, wherein the percussion mechanism further comprises an adapter housing, connectable to the first or second accumulator assembly to configure each of the first or second accumulator elements as either a pressure accumulator or a return accumulator.

11. A hydraulic down-the-hole hammer as claimed in claim 1, further comprising:

a shuttle valve configured to control reciprocation of the piston, the first accumulator assembly being arranged proximate to the shuttle valve, the shuttle valve having a shuttle valve diameter and a shuttle valve surface, the shuttle valve surface controlling flow of fluid into and out of the first accumulator assembly, wherein each of the first accumulator elements comprises an accumulator membrane or an accumulator piston, and wherein a minimum distance between at least one of the accumulator membranes or accumulator pistons and the shuttle valve surface during operation of the percussion mechanism is less than or equal to ten times the shuttle valve diameter.

12. A hydraulic down-the-hole hammer as claimed in claim 1, wherein the piston is configured to directly impact the percussion bit.

13. A hydraulic down-the-hole hammer as claimed in claim 1, wherein the percussion bit is located at a forward end of the outer wear sleeve to form a distal-most portion of the percussion mechanism.

14. A hydraulic down-the-hole hammer, comprising:

a hydraulically powered percussion mechanism, comprising:

a piston configured to impact a percussion bit; and a first accumulator assembly for hydraulic fluid, the first accumulator assembly comprising a plurality of first accumulator elements fully encased in a monolithic common housing, each of the first accumulator elements being arranged at the same proximity to the piston, at least one of the first accumulator elements being a pressure accumulator, at least another one of the first accumulator element being a return accumulator; and an external cylindrical outer wear sleeve within which the hydraulically powered percussion mechanism is disposed entirely, wherein the piston is mounted to reciprocate movement within the outer wear sleeve to strike the percussion bit, and wherein the percussion bit is located at a forward end of the outer wear sleeve.

15. A hydraulic down-the-hole hammer as claimed in claim 14, wherein the percussion mechanism further comprises a shuttle valve configured to control reciprocation of the piston, the shuttle valve having a shuttle valve diameter, wherein the first accumulator assembly is arranged proximate to the shuttle valve.

16. A hydraulic down-the-hole hammer as claimed in claim 14, wherein the piston is configured to directly impact the percussion bit.

17. A hydraulic down-the-hole hammer as claimed in claim 14, wherein the percussion bit is located at a forward end of the outer wear sleeve to form a distal-most portion of the percussion mechanism.

18. A hydraulic down-the-hole hammer, comprising:

a hydraulically powered percussion mechanism, comprising:

a piston configured to impact a percussion bit;

a shuttle valve configured to control reciprocation of the piston, the shuttle valve having a shuttle valve diameter; and a first accumulator assembly for hydraulic fluid, the first accumulator assembly being arranged proximate to the shuttle valve, the first accumulator assembly comprising a plurality of first accumulator elements fully encased in a monolithic common housing, each of the first accumulator elements comprising an accumulator membrane or an accumulator piston; and an external cylindrical outer wear sleeve within which the hydraulically powered percussion mechanism is entirely disposed wherein the shuttle valve has a surface that controls flow of fluid into and out of the first accumulator assembly, wherein a minimum distance between at least one of the accumulator membranes or accumulator pistons and the shuttle valve surface during operation of the percussion mechanism is less than or equal to three times the shuttle valve diameter, wherein the piston is mounted to reciprocate movement within the outer wear sleeve to strike the percussion bit, and wherein the percussion bit is located at a forward end of the outer wear sleeve, and wherein a minimum distance between at least another one of the accumulator membranes or accumulator pistons and the shuttle valve surface during operation of the percussion mechanism is less than or equal to ten times the shuttle valve diameter.

19. A hydraulic down-the-hole hammer as claimed in claim 18, wherein the piston is configured to directly impact the percussion bit.

20. A hydraulic down-the-hole hammer as claimed in claim 18, wherein the percussion bit is located at a forward end of the outer wear sleeve to form a distal-most portion of the percussion mechanism.

* * * * *